US010465683B2

(12) United States Patent
Liang et al.

(10) Patent No.: US 10,465,683 B2
(45) Date of Patent: Nov. 5, 2019

(54) COMPRESSOR, AIR CONDITIONING SYSTEM, AND A METHOD OF CONTROLLING A COMPRESSOR

(71) Applicant: Gree Green Refrigeration Technology Center Co., Ltd. of Zhuhai, Zhuhai (CN)

(72) Inventors: Shebing Liang, Zhuhai (CN); Liying Deng, Zhuhai (CN); Guomang Yang, Zhuhai (CN); Jian Zhang, Zhuhai (CN); Jia Xu, Zhuhai (CN); Yusheng Hu, Zhuhai (CN)

(73) Assignee: Gree Green Refridgeration Technology Center Co., Ltd. of Zhuhai, Zhuhai (CN)

( * ) Notice: Subject to any disclaimer, the term of this patent is extended or adjusted under 35 U.S.C. 154(b) by 287 days.

(21) Appl. No.: 15/524,331

(22) PCT Filed: Jul. 6, 2015

(86) PCT No.: PCT/CN2015/083397
§ 371 (c)(1),
(2) Date: May 4, 2017

(87) PCT Pub. No.: WO2016/070640
PCT Pub. Date: May 12, 2016

(65) Prior Publication Data

US 2017/0314560 A1 Nov. 2, 2017

(30) Foreign Application Priority Data

Nov. 5, 2014 (CN) ..... 2014 1 0621492

(51) Int. Cl.
*F04C 18/356* (2006.01)
*F04C 23/00* (2006.01)
*F04C 28/06* (2006.01)

(52) U.S. Cl.
CPC ..... *F04C 18/356* (2013.01); *F04C 23/00* (2013.01); *F04C 23/003* (2013.01); *F04C 28/06* (2013.01)

(58) Field of Classification Search
CPC ..... F04C 23/00; F04C 23/003; F04C 28/18; F04C 28/06
See application file for complete search history.

(56) References Cited

U.S. PATENT DOCUMENTS 5,871,342 A 2/1999 Harte et al.
5,993,171 A 11/1999 Higashiyama
(Continued)

FOREIGN PATENT DOCUMENTS

CN 1482364 A 3/2004
CN 202954971 U 5/2013
(Continued)

*Primary Examiner* — Mary Davis
(74) *Attorney, Agent, or Firm* — The Webb Law Firm

(57) ABSTRACT

A compressor includes two parallel arranged primary cylinders and a secondary cylinder arranged in the downstream of the two primary cylinders. The secondary cylinder includes a cylinder body and a sliding vane. The sliding vane is arranged inside the cylinder body. A locking part is used for locking and unlocking the sliding vane. The locking part is clamped with and separated from the sliding vane. When the sliding vane is in the locking position, the sliding vane is locked in a seal cavity inside the secondary cylinder, and the locking end of the locking part extends to the side at which the secondary cylinder is located. The compressor can be switched between a single-stage mode and a double-stage mode. In the condition of light load, energy efficiency can be improved and the waste of energy sources is avoided. An air conditioning system and compressor control method are also disclosed.

17 Claims, 5 Drawing Sheets

(56) References Cited

U.S. PATENT DOCUMENTS

| | | | | |
|---|---|---|---|---|
| 8,225,624 | B2 * | 7/2012 | Yamaguchi | F04C 23/001 62/175 |
| 2017/0022988 | A1 | 1/2017 | Huang et al. | |
| 2017/0030355 | A1 * | 2/2017 | Huang | F04C 23/00 |

FOREIGN PATENT DOCUMENTS

| | | | | | |
|---|---|---|---|---|---|
| CN | 103953544 | A | | 7/2014 | |
| CN | 103953545 | A | | 7/2014 | |
| CN | 103982426 | A | | 8/2014 | |
| CN | 204212984 | U | | 3/2015 | |
| EP | 0816685 | A1 | | 1/1998 | |
| JP | 05106576 | A | * | 4/1993 | F04C 23/001 |
| JP | 8151988 | A | | 6/1996 | |
| JP | 200182345 | A | | 3/2001 | |

* cited by examiner

COMPRESSOR, AIR CONDITIONING SYSTEM, AND A METHOD OF CONTROLLING A COMPRESSOR

CROSS-REFERENCE TO RELATED APPLICATIONS

This application is the United States national phase of International Application No. PCT/CN2015/083397 filed Jul. 6, 2015, and claims priority to Chinese Patent Application No. 201410621492.6 filed Nov. 5, 2014, the disclosures of which are hereby incorporated in their entirety by reference.

FIELD OF THE INVENTION

The present application relates to heat exchange systems, and more specifically to a compressor, an air conditioning system, and a method of controlling a compressor.

BACKGROUND OF THE INVENTION

With increasingly strict requirement of national energy efficiency index, the existing two-stage enthalpy-increasing compressors solve the problem of insufficient heating capacity at low temperatures by air supplying and enthalpy increasing, thereby increasing heating capacity of an air-conditioning system.

A two-stage enthalpy-increasing compressor in the prior art comprises one secondary cylinder and two primary cylinders that supply air to the secondary cylinder. Under a heavy load working condition (e.g., nominal refrigeration, nominal heating, national standard working condition, low-temperature working condition, etc.), in the case of a relative large pressure ratio, two-stage compression may effectively allocate the pressure ratio, such that the primary-stage cylinder and the secondary-stage cylinder can operate efficiently. However, under a low load working condition (e.g., IPLV working condition, intermediate working condition, etc.), in the case of a relatively lower pressure ratio, pressure-ratio allocation by two-stage compression will be less efficient, which easily causes a too small pressure ratio allocated to the first-stage cylinder or the secondary-stage cylinder; at this point, the cylinder essentially becomes one resistive component with a gas exhaust valve disc, thereby reducing compressor energy efficiency.

Due to not having a single-stage working mode, the two-stage compressor in the prior art cannot switch between the two-stage working mode and the single-stage working mode, resulting in a low energy-efficiency of the compressor in a low load working condition.

SUMMARY OF THE INVENTION

The present application intends to provide a compressor, an air-conditioning system, and a method of controlling a compressor, so as to solve the low energy-efficiency issue of the compressor in a low load working condition.

In order to solve the technical problem above, according to one aspect of the present application, there is provided a compressor, comprising: two primary-stage cylinders disposed in parallel; a secondary cylinder disposed downstream of the two primary-stage cylinders, comprising a cylinder body and a sliding vane provided inside the cylinder body; and a locking part for locking or unlocking the sliding vane, the locking part being engaged to or disengaged from the sliding vane, such that when the sliding vane is in a locked position, the sliding vane is locked within a closed cavity of the secondary-stage cylinder, and a locking end of the locking part protrudes towards the secondary-stage cylinder.

Further, the compressor further comprises an enthalpy-increasing component which comprising: an enthalpy-increasing cavity, the secondary cylinder being in communication with the secondary-stage cylinder; each of the two primary-stage cylinders being in communication with the enthalpy-increasing cavity, and the locking part being slidably disposed within the enthalpy-increasing cavity, and a locking end of the locking part protruding towards the sliding vane; and an air supply part for supplying air to the secondary-stage cylinder via the enthalpy-increasing cavity, the air supply part being connected to the enthalpy-increasing cavity.

Further, the locking part comprises a locking pin, a first end of the locking pin being the locking end, a first end of the locking pin having an engaging groove that is engaged to or disengaged from the sliding vane.

Further, the locking part comprises a locking pin, a first end of the locking pin serves as the locking end, the sliding vane having a locking mating part matable with the locking end, the locking end is able to lock or unlock the locking mated part.

Further, a first end of the locking pin has a locking bump, and the locking mating part serves as a locking recess, and the locking bump is able to lock or unlock the locking recess.

Further, the compressor further comprises a resetting element for keeping the locking part at a locked position, the resetting element being disposed within the enthalpy-increasing cavity and at a reset end of the locking part, the reset end being disposed opposite to the locking end.

Further, the reset end has a receiving recess, and at least part of the resetting element being disposed within the receiving recess.

Further, the enthalpy-increasing component is also provided with an exhaust port, the compressor also comprises a control valve, the exhaust port being in communication with the enthalpy-increasing cavity, and the control valve controlling opening and closing states of the exhaust port.

According to another aspect of the application, there is an air conditioning system, comprising a compressor as above mentioned.

According to another aspect of the application, there is a compressor controlling method, comprising: controlling a locking part to engage to or disengage from a sliding vane of a secondary-stage cylinder so as to lock or unlock the sliding vane, such that when the sliding vane is engaged with the locking part, the sliding vane is locked within a closing cavity of the cylinder of the secondary-stage cylinder, to offload the secondary-stage cylinder and cause the two primary-stage cylinders to work.

Further, according to a magnitude relationship between an air pressure of the secondary-stage cylinder and an air pressure in the two primary-stage cylinders, controlling the locking part to engage with or disengage from the secondary-stage cylinder, so as to lock or unlock the secondary-stage cylinder, an air pressure of the secondary-stage cylinder being a sum of air pressures of the two primary-stage cylinders and an air pressure of an air supply part.

Further, when the air supply part supplies air, the air pressure in the secondary-stage cylinder is larger than the air pressures in the two primary-stage cylinders; the locking part moves far away from the secondary-stage cylinder; the locking part unlocks the sliding vane of the secondary-stage cylinder; the secondary-stage cylinder is in a working state; and when the air supply part is closed, the air pressure within the secondary-stage cylinder is equal to the air pressures within the two primary-stage cylinders; the locking part moves towards the secondary-stage cylinder under a resetting action force of the resetting element; the locking part locks the sliding vane of the secondary-stage cylinder, and the secondary-stage cylinder is in an offloaded state.

Further, when the air supply part supplies air, the control valve controls the exhaust gas to close, so as to make the secondary-stage cylinder exhaust; and when the air supply part is closed, the control valve controls the exhaust port to open so as to make the enthalpy-increasing cavity exhaust.

In the present application, there exist two primary-stage cylinders that are arranged in parallel; the secondary-stage cylinder is disposed downstream of the two primary-stage cylinders; the secondary-stage cylinder comprises a cylinder body and a sliding vane that is disposed inside the cylinder body; when the sliding vane is provided inside a locked position, the sliding vane is locked within the closed cavity of the secondary-stage cylinder; a locking end of the locking part protrudes towards the secondary-stage cylinder; the locking part is engaged with or disengaged from the secondary-stage cylinder for locking or unlocking the sliding vane. Due to providing of the locking part, disengagement of the locking part from the sliding vane may unlock the secondary-stage cylinder, such that the compressor switches to run in a two-stage mode; or engagement of the locking part with the sliding vane may lock the secondary-stage cylinder, such that the compressor switches to run in a single-stage mode; in this way, energy-efficiency may be enhanced when the compressor works in a low load working condition, which avoids energy waste. Because the compressor enables switching between two-stage and single-stage modes, operation reliability of the compressor is enhanced, such that the compressor may have a high energy-efficiency in various working conditions.

BRIEF DESCRIPTION OF THE ACCOMPANYING DRAWINGS

The drawings illustrated here are for providing further understanding of the present application and thus constitute part of the present application. The exemplary embodiments of the present application and depictions thereof are for interpreting the present application, not constituting improper limitations of the present application. In the drawings.

Figure 1:
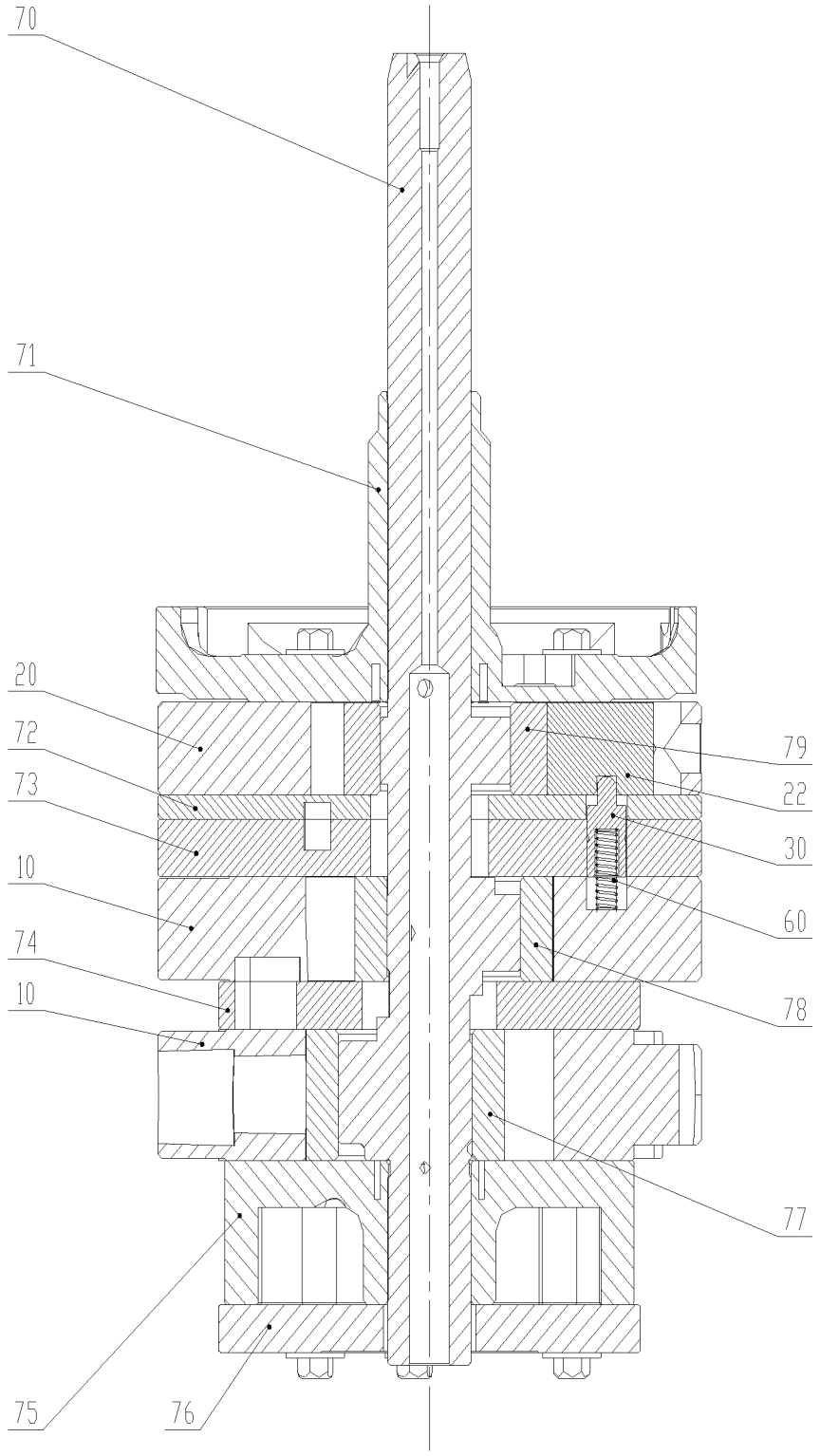
FIG. 1 is a schematic diagram of a structure of a compressor in the present application.

Reference numerals in the accompanying drawings: 10. Primary-stage cylinder; 20. Secondary-stage cylinder; 21. Cylinder body; 22. Sliding vane; 30. Locking part; 31. Locking end; 31*a*. Locking bump; 32. Resetting end; 41: Enthalpy-increasing cavity; 42. Air supply part; 42*a*. Air supply valve; 50. Control valve; 60. Resetting element; 70. Crankshaft; 71. Upper flange; 72. Upper partition plate; 73. Middle partition plate; 74. Lower partition plate; 75. Lower flange; 76. Cover plate; 77. Lower roller; 78. Middle roller; 79. Secondary-stage cylinder roller; 80. Liquid dispenser.

DETAILED DESCRIPTION OF THE PREFERRED EMBODIMENTS

Hereinafter, embodiments of the present application may be described in detail with reference to the accompanying drawings. However, the present application may be implemented in a plurality of various manners limited and covered by the claims.

As a first aspect of the present application, there is provided a compressor. As shown in FIGS. 1-5, the compressor comprises a primary-stage cylinder 10, a secondary-stage cylinder 20, and a locking part 30 adapted to lock or unlock a sliding vane 22; there exist two primary-stage cylinders 10 that are provided in parallel; the secondary-stage cylinder 20 is disposed downstream of the two primary-stage cylinders 10, and comprises a cylinder body 21 and a sliding vane 22 that is provided inside the cylinder body 21. The locking part 30 is engaged to or disengaged from the sliding vane 22, such that when the sliding vane 22 is in a locked position, the sliding vane 22 is locked within a closed cavity of the secondary-stage cylinder 20. Besides, a locking end 31 of the locking part 30 protrudes towards the secondary-stage cylinder 20. Due to providing of the locking part 30, disengagement of the locking part 30 from the sliding vane 22 may unlock the secondary-stage cylinder 20, such that the compressor switches to run in a two-stage mode; or engagement of the locking part 30 with the sliding vane 22 could lock the secondary-stage cylinder 20, such that the compressor switches to run in a single-stage mode. In this way, energy-efficiency may be improved when the compressor works in a low load, which avoids energy waste. Because the compressor enables switching between two-stage and single-stage modes, operation reliability of the compressor is enhanced, such that the compressor have a high energy-efficiency in various working conditions.

The compressor in the present application further comprises an enthalpy-increasing component that comprises: an enthalpy-increasing cavity 41 and an air supply part 42 that supplies air to the secondary-stage cylinder 20, the secondary-stage cylinder 20 being in communication with the enthalpy-increasing cavity 41. Each of the two primary-stage cylinders 10 is in communication with the enthalpy-increasing cavity 41. A locking part 30 is slidably provided in the enthalpy-increasing cavity 41, and the locking end 31 of the locking part 30 is protruding towards the secondary-stage cylinder 20. The air supply part 42 is connected to the enthalpy-increasing cavity 41. Due to providing of the air supply part 42, an air supply operation may be performed to the secondary-stage cylinder 20, thereby guaranteeing working reliability of the secondary-stage cylinder 20, such that the compressor can satisfy the working requirement of heavy load. Because the locking part 30 is slidably disposed within the enthalpy-increasing cavity 41, and both of the primary-stage cylinders 10 and secondary-stage cylinder 20 are in communication with the enthalpy-increasing cavity 41. A pressure difference between the secondary-stage cylinder 20 and the primary-stage cylinders 10 may control the position of the locking part 30 within the enthalpy-increasing cavity 41, thereby engaging or disengaging the locking part 30 with or from the secondary-stage cylinder 20.

Preferably, the air supply valve 42*a* controls on or off of the air supply part 42.

The locking part 30 in the present application comprises a locking pin. A first end of the locking pin serves as a locking end 31, and the sliding vane 22 has a locking mating part matable with the locking end 31. The locking end 31 may lock or unlock the locking mated part. Because the sliding vane 22 has a locking mated part matable with the locking end 31, reliability of locking between the locking pin and the sliding vane 22 is guaranteed.

Figure 2:
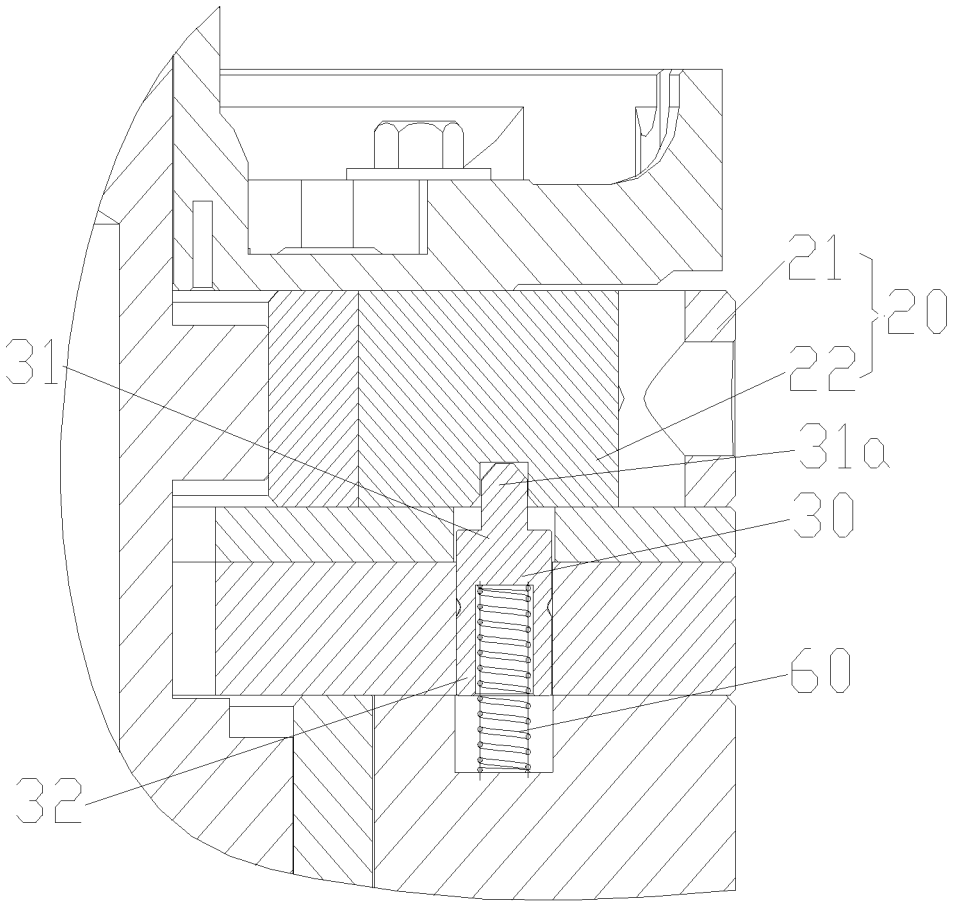
FIG. 2 is a schematic diagram of a working state of a locking part of the present application in a locked position.
Figure 3:
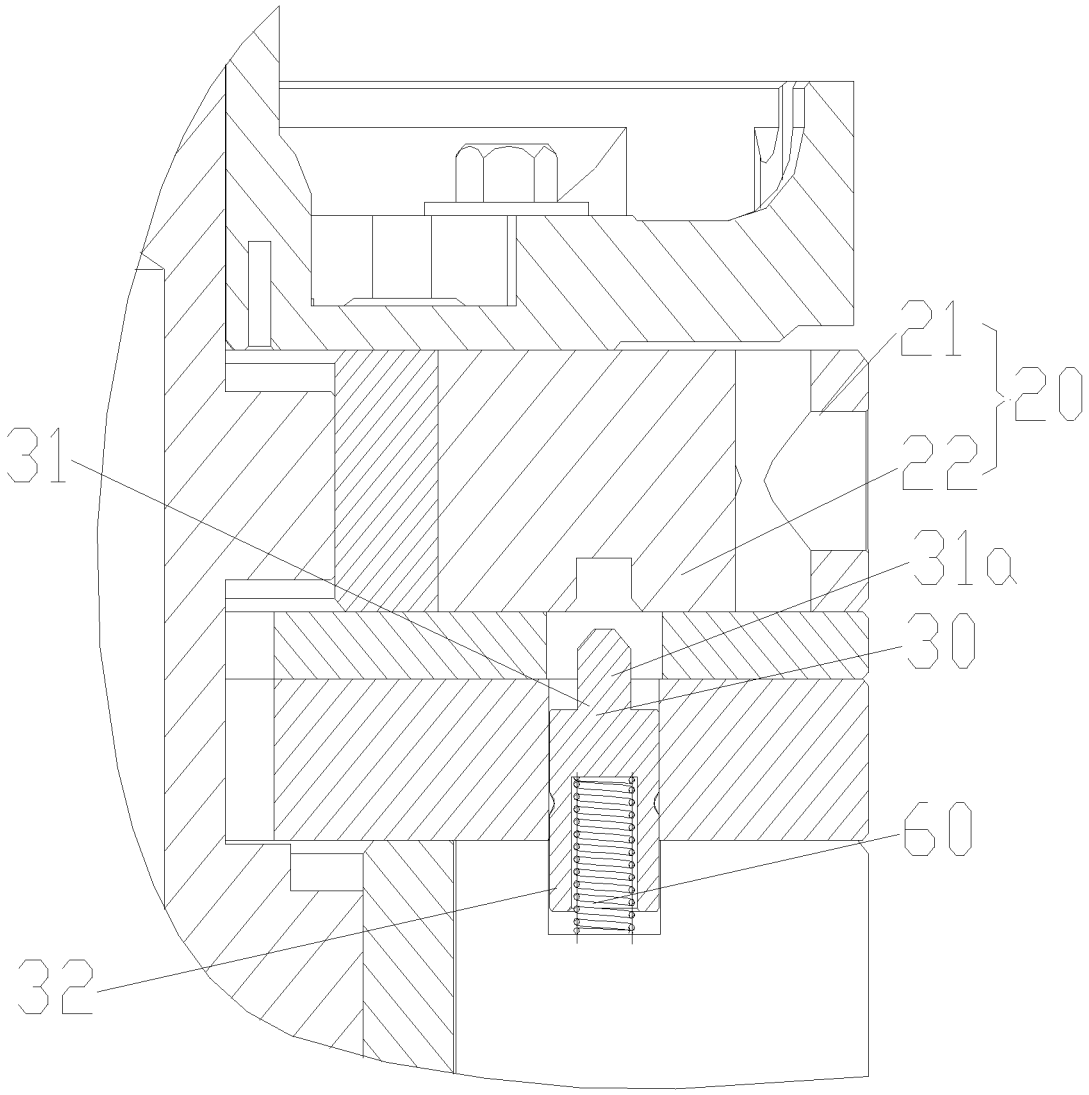
FIG. 3 is a schematic diagram of a working state of a locking part of the present application in an unlocked position.

In the preferred embodiments shown in FIGS. 2 and 3, a first end of the locking pin has a locking bump 31*a*, the locking mating part is a locking recess, the locking bump 31*a* may lock or unlock the locking recess. When the locking bump 31*a* projects into the locking recess, the locking pin locks the sliding vane 22. When the locking bump 31*a* retracts from the inside of the locking recess, the locking pin unlocks the sliding vane 22.

In a preferred embodiment that is not shown, the locking part 30 comprises a locking pin, a first end of the locking pin severs as a locking end 31, a first end of the locking pin has an engaging groove that is engaged to or disengaged from the sliding vane 22. When the engaging groove of the locking pin is engaged with a surface of the sliding vane 22, the locking pin locks the sliding vane 22; when the engaging groove of the locking pin is disengaged from the sliding vane 22, the sliding vane 22 is unlocked.

The compressor in the present application further comprises a resetting element 60 for keeping the locking part 30 at a locked position, the resetting element 60 being disposed within the enthalpy-increasing cavity 41 and at a reset end 32 of the locking part 30, the reset end 32 being disposed opposite to the locking end 31. Due to providing of the resetting element 60, the resetting element 60 always provides a reset acting force to the locking part 30, such that the locking part 30 can be maintained at the locking position. When the air pressure of the secondary-stage cylinder 20 is far larger than the air pressure within the primary-stage cylinder 10, the locking part 30 will overcome the reset acting force of the resetting element 60 so as to be disengaged from the secondary-stage cylinder 20.

In the preferred embodiment shown in FIGS. 2 and 3, the resetting end 32 has a receiving recess, at least part of the resetting element being disposed within the receiving recess. Because the resetting end 32 has the receiving recess, when the locking part 30 is located at an unlocked position, the resetting element 60 may be retracted back into the receiving recess, thereby avoiding that the resetting element 60 and the locking part 30 occupy a too much space. Meanwhile, connection reliability between the resetting element 60 and the locking part 30 is also guaranteed.

The enthalpy-increasing component in the present application further comprises an exhaust port; the compressor further comprises a control valve 50; the exhaust port is in communication with the enthalpy-increasing cavity 41; the control valve 50 controls on and off states of the exhaust port. Because the control valve 50 may control the on and off states of the exhaust port, the usage state of the exhaust port may be switched through the control valve 50 based on whether the secondary-stage cylinder 20 needs to work, thereby enhancing usage reliability of the compressor. Preferably, the control valve 50 is an electromagnetic valve.

The compressor in the present application further comprises a crankshaft 70, an upper flange 71, an upper partition plate 72, a middle partition plate 73, a lower partition plate 74, a lower flange 75, a cover plate 76, a lower roller 77, a middle roller 78, and a secondary-stage cylinder roller 79, wherein the upper partition plate 72 and the middle partition plate 73 are parts of the enthalpy-increasing component and form the enthalpy-increasing cavity 41. The assembly relationships between respective components along a length direction of the crankshaft 70 are sequentially: the upper flange 71, the secondary-stage cylinder 20, the upper partition plate 72, the middle partition plate 73, one primary-stage cylinder 10, the lower partition plate 74, another primary-stage cylinder 10, the lower flange 75, and the cover plate 76, wherein the lower roller 77 is disposed within the another primary-stage cylinder 10, the middle roller 78 is disposed within the one first-primary cylinder 10, and the secondary-stage cylinder roller 79 is disposed within the secondary-stage cylinder 20.

The compressor in the present application further comprises a liquid dispenser 80, and the liquid dispenser 80 is connected to two primary-stage cylinders 10, for supplying air to the two primary-stage cylinders 10.

As a second aspect of the present application, there is provided an air-conditioning system. The air-conditioning system comprises a compressor as mentioned above. Because the compressor in the present application has a function of switching between two-stage and single-stage working modes, it may satisfy use requirements of the air-conditioning system under various working conditions and effectively guaranteeing working reliability of the compressor and the air-conditioning system, such that the compressor and the air-conditioning system can have a high energy-efficiency under various working conditions.

Figure 4:
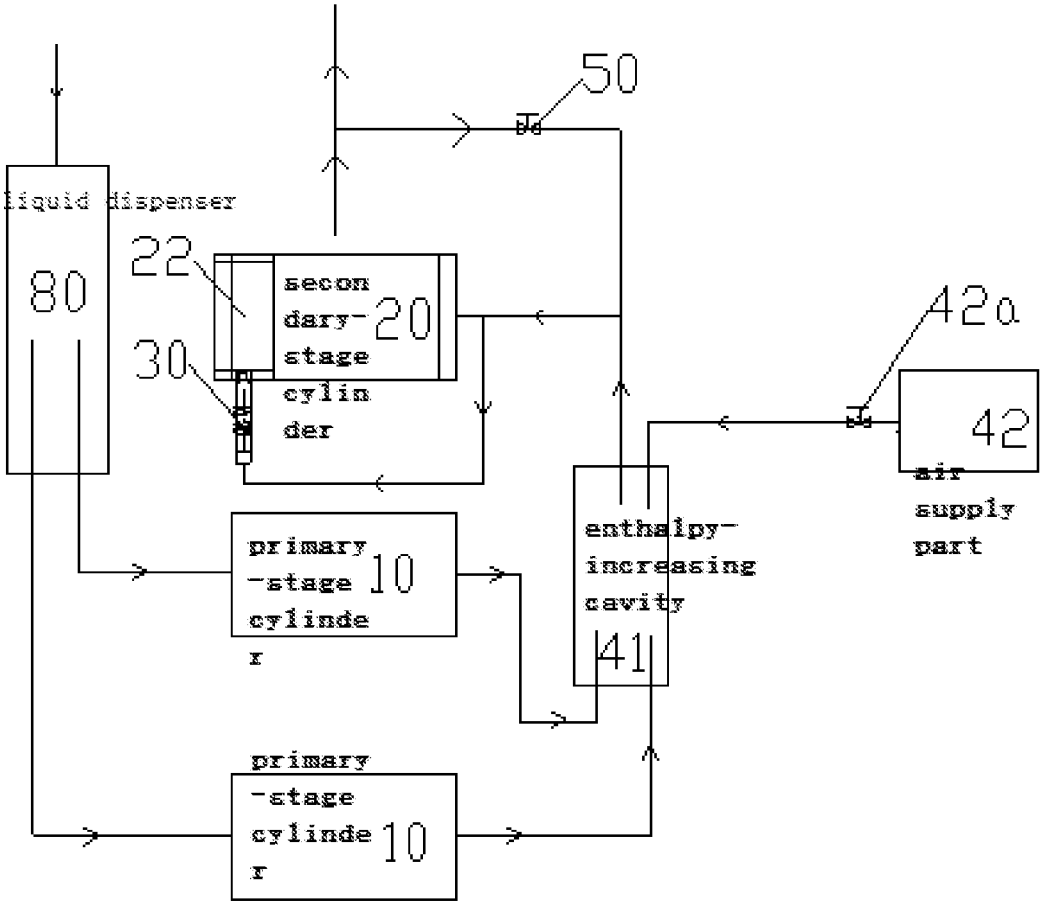
FIG. 4 is a principle diagram of a compressor operation mode when a locking part of the present application is in a locked position.
Figure 5:
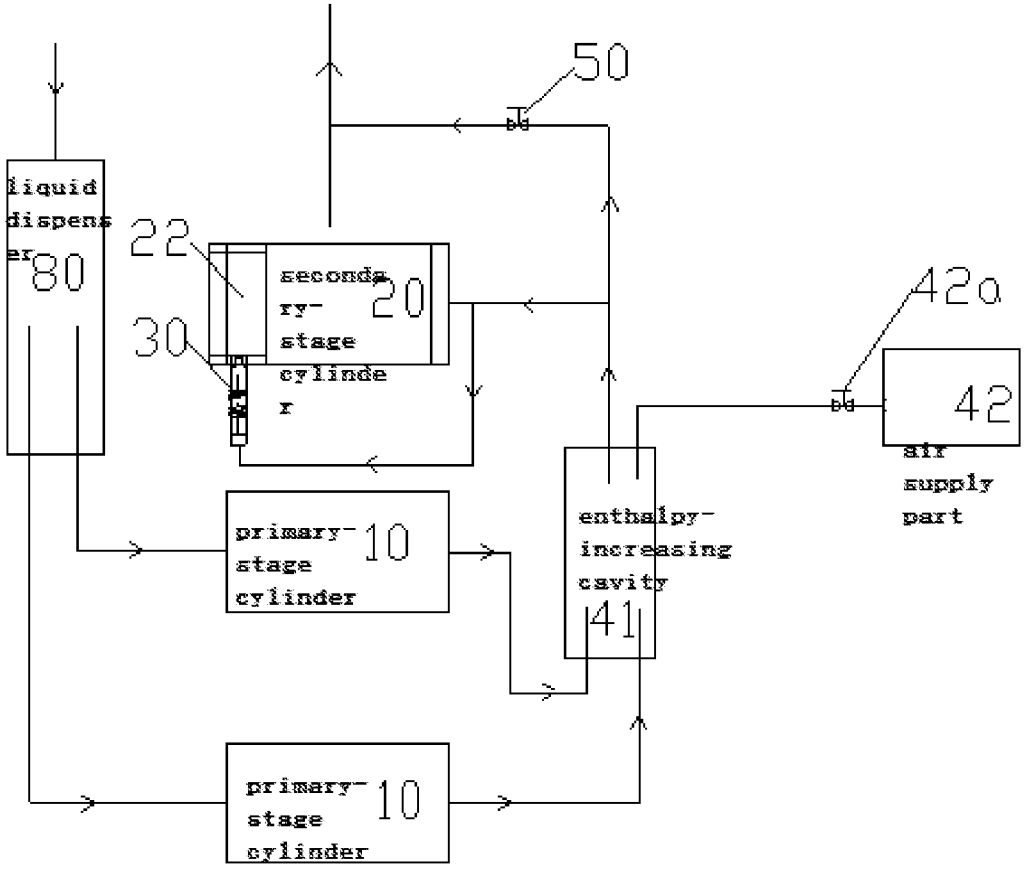
FIG. 5 is a principle diagram of a compressor operation mode when a locking part of the present application is in an unlocked position.

As a third aspect of the present application, there is provided a compressor controlling method. As shown in FIGS. 4 and 5, the compressor controlling method comprises: controlling the locking part to engage to or disengage from a secondary-stage cylinder so as to lock or unlock a sliding vane 22, such that when the sliding vane 22 is engaged with the locking part 30, the sliding vane 22 is locked within the closing cavity of the cylinder 21 of the secondary-stage cylinder 20, to offload the secondary-stage cylinder 20 and cause the two primary-stage cylinders 10 to work. Because the working mode of the compressor may be changed by changing the mating condition of the locking part 30 and the slide vane 22, this enables the compressor to effectively switch between two-stage and single-stage modes, and thus operation reliability of the compressor is enhanced, such that the compressor have a high energy-efficiency in various working conditions.

Preferably, based on magnitude relationship between the air pressure in the secondary-stage cylinder 20 and two primary-stage cylinders 10, the locking part 30 is controlled to be engaged with or disengaged from the secondary-stage cylinder 20 so as to lock or unlock the secondary-stage cylinder 20; the air pressure in the secondary-stage cylinder 20 is a sum of the air pressure in the two primary-stage cylinders 10 and the air pressure in the air supply part 42. Because pressure difference exists between the secondary-stage cylinder 20 and the primary-stage cylinder 10 in some working conditions, by controlling the position of the locking part 30 based on the pressure relationship between the secondary-stage cylinder 20 and the first-stage cylinder 10, the locking part 30 unlocks or locks the secondary-stage cylinder 20, such that the compressor has a function of switching between the two-stage and single-stage working modes.

As shown in FIG. 4, when the air supply part 42 supplies air, the controlling valve 50 controls the exhaust port to close so as to make the secondary-stage cylinder 20 exhaust; moreover, the air pressure in the secondary-stage cylinder 20 is larger than the air pressure within the two primary-stage cylinders 10; the locking part 30 moves far away from the secondary-stage cylinder 20; the locking part 30 unlocks the sliding vane 22 of the secondary-stage cylinder 20; and the secondary-stage cylinder 20 is in a working state. In a heavy-load working condition, the two-stage operation mode of the compressor is opened, the air supply valve 42*a* is opened, the air supply part 42 performs an air supply operation, the control valve 50 is closed, and the exhaust port is closed. At this point, a low-pressure gas Ps entering the liquid dispenser 80 enters into the two primary-stage cylinders 10 for being suctioned and compressed; the middle-pressure gas Pm resulting from compression in the two primary-stage cylinders 10 and the air supply gas Pm are mixed within the enthalpy-increasing cavity 41 and then enter into the gas inlet port of the secondary-stage cylinder 20; at this point, a lower end of the locking part 30 is under a middle pressure Pm, while an upper end of the locking part 30 is under a high pressure Pd; the locking part 30 moves downward under the action of the gas pressure difference Pd–Pm; the sliding vane 22, after being unlocked, operates; the secondary-stage cylinder 20 exhaust the compressed high-pressure gas through the inside of the housing of the compressor to the exhaust pipe and then into the air-conditioning system, thereby implementing a three-cylinder two-stage operation mode.

As shown in FIG. 5, when the air supply part 42 is closed, the control valve 50 controls the exhaust port to open so as to make the enthalpy-increasing cavity 41 exhaust. The air pressure in the secondary-stage cylinder 20 is equal to the air pressure within the two primary-stage cylinders 10. Under the resetting action force of the resetting element 60, the locking part 30 moves towards the secondary-stage cylinder 20; the locking part 30 locks the sliding vane 22 of the secondary-stage cylinder 20, and the secondary-stage cylinder 20 is in an offloaded state. In a low load condition, the two-cylinder single-stage operation mode of the compressor is opened. The air supply valve 42*a* is closed, and the control valve 50 is opened, and the exhaust port is opened. At this point, the low-pressure gas Ps entering from the liquid dispenser 80 enters into the two primary-stage cylinders 10 for being suctioned and compressed, respectively; an exhaust high pressure Pd resulting from compression in the two primary-stage cylinders 10 enters into the air inlet port of the secondary-stage cylinder 20 through the enthalpy-increasing cavity 41. At this point, the lower end of the locking part 30 is under a high pressure Pd, the upper end of the locking part 30 is under high pressure Pd; the locking part 30 moves upward under the resetting action of the resetting element; the sliding vane 22 is locked; the secondary-stage cylinder 20 is offloaded to stop work; the high-pressure gas enters into the compressor housing from the enthalpy-increasing cavity 41 through the control valve 50, and then exhausted into the air-conditioning system, thereby implementing a two-cylinder single-stage operation mode.

The compressor in the present application can effectively solve the low energy-efficiency issue in the low load working condition, enhance its operating efficiency in the low load working condition, and also can implementing switching between the three-cylinder two-stage operation mode and the two-cylinder single-stage operation mode.

What have been discussed above are only preferred embodiments of the present application, not for limiting the present application. For those skilled in the art, the present application may have various changes and variations. Any modification, equivalent replacement, improvement within the principle and spirit of the present application should be included within the protection scope of the present application.

The invention claimed is:

1. A compressor, comprising:

two primary-stage cylinders disposed in parallel;

a secondary-stage cylinder disposed downstream of the two primary-stage cylinders, comprising a cylinder body and a sliding vane provided inside the cylinder body; and a locking part for locking or unlocking the sliding vane, the locking part being engaged to or disengaged from the sliding vane, such that when the sliding vane is in a locked position, the sliding vane is locked within a closed cavity of the secondary-stage cylinder, and a locking end of the locking part protrudes towards the secondary-stage cylinder;

an enthalpy-increasing component, comprising:

an enthalpy-increasing cavity, the secondary-stage cylinder being in communication with the enthalpy-increasing cavity; each of the two primary-stage cylinders being in communication with the enthalpy-increasing cavity, and the locking part being slidably disposed within the enthalpy-increasing cavity, and a locking end of the locking part protruding towards the sliding vane; and an air supply part for supplying air to the secondary-stage cylinder via the enthalpy-increasing cavity, the air supply part being connected to the enthalpy-increasing cavity; and a resetting element, for keeping the locking part at a locked position, the resetting element being disposed within the enthalpy-increasing cavity and at a reset end of the locking part, the reset end being disposed opposite to the locking end.

2. The compressor according to claim 1, wherein the locking part comprises a locking pin, a first end of the locking pin being the locking end, a first end of the locking pin having an engaging groove that is engaged to or disengaged from the sliding vane.

3. The compressor according to claim 1, wherein the locking part comprises a locking pin, a first end of the locking pin serving as the locking end, the sliding vane having a locking mating part matable with the locking end, the locking end is able to lock or unlock the locking mated part.

4. The compressor according to claim 3, wherein a first end of the locking pin has a locking bump, and the locking mating part serves as a locking recess, and the locking bump is able to lock or unlock the locking recess.

5. The compressor according to claim 1, wherein the reset end has a receiving recess, and at least part of the resetting element being disposed within the receiving recess.

6. The compressor according to claim 1, wherein the enthalpy-increasing component is also provided with an exhaust port, the compressor also comprises a control valve, the exhaust port being in communication with the enthalpy-increasing cavity, and the control valve controlling opening and closing states of the exhaust port.

7. An air conditioning system, comprising a compressor according to claim 1.

8. The air conditioning system according to claim 7, wherein the compressor further comprises an enthalpy-increasing component comprising:

an enthalpy-increasing cavity, the secondary-stage cylinder being in communication with the enthalpy-increasing cavity; each of the two primary-stage cylinders being in communication with the enthalpy-increasing cavity, and the locking part being slidably disposed within the enthalpy-increasing cavity, and a locking end of the locking part protruding towards the sliding vane; and an air supply part for supplying air to the secondary-stage cylinder via the enthalpy-increasing cavity, the air supply part being connected to the enthalpy-increasing cavity.

9. The air conditioning system according to claim 8, wherein the locking part comprises a locking pin, a first end of the locking pin being the locking end, a first end of the locking pin having an engaging groove that is engaged to or disengaged from the sliding vane.

10. The air conditioning system according to claim 8, wherein the locking part comprises a locking pin, a first end of the locking pin serving as the locking end, the sliding vane having a locking mating part matable with the locking end, the locking end is able to lock or unlock the locking mated part.

11. The air conditioning system according to claim 10, wherein a first end of the locking pin has a locking bump, and the locking mating part serves as a locking recess, and the locking bump is able to lock or unlock the locking recess.

12. The air conditioning system according to claim 8, wherein the compressor further comprises a resetting element for keeping the locking part at a locked position, the resetting element being disposed within the enthalpy-increasing cavity and at a reset end of the locking part, the reset end being disposed opposite to the locking end.

13. The air conditioning system according to claim 12, wherein the reset end has a receiving recess, and at least part of the resetting element being disposed within the receiving recess.

14. The air conditioning system according to claim 8, wherein the enthalpy-increasing component is also provided with an exhaust port, the compressor also comprises a control valve, the exhaust port being in communication with the enthalpy-increasing cavity, and the control valve controlling opening and closing states of the exhaust port.

15. A compressor controlling method, comprising: controlling a locking part to engage to or disengage from a sliding vane of a secondary-stage cylinder so as to lock or unlock the sliding vane, such that when the sliding vane is engaged with the locking part, the sliding vane is locked within a closing cavity of the cylinder of the secondary-stage cylinder, to offload the secondary-stage cylinder and cause two primary-stage cylinders to work; and according to a magnitude relationship between an air pressure of the secondary-stage cylinder and that in the two primary-stage cylinders, controlling the locking part to engage with or disengage from the secondary-stage cylinder, so as to lock or unlock the secondary-stage cylinder, an air pressure of the secondary-stage cylinder being a sum of air pressures of the two primary-stage cylinders and an air pressure of an air supply part.

16. The compressor controlling method according to claim 15, wherein:

when the air supply part supplies air, the air pressure in the secondary-stage cylinder is larger than the air pressures in the two primary-stage cylinders; the locking part moves far away from the secondary-stage cylinder; the locking part unlocks the sliding vane of the secondary-stage cylinder; the secondary-stage cylinder is in a working state; and when the air supply part is closed, the air pressure within the secondary-stage cylinder is equal to the air pressures within the two primary-stage cylinders; the locking part moves towards the secondary-stage cylinder under a resetting action force of the resetting element; the locking part locks the sliding vane of the secondary-stage cylinder, and the secondary-stage cylinder is in an offloaded state.

17. The compressor controlling method according to claim 15, wherein:

when the air supply part supplies air, the control valve controls the exhaust gas to close, so as to make the secondary-stage cylinder exhaust; and when the air supply part is closed, the control valve controls the exhaust port to open so as to make the enthalpy-increasing cavity exhaust.

* * * * *